United States Patent [19]

Skees et al.

[11] 4,360,548

[45] Nov. 23, 1982

[54] SELF-CONTAINED COVERT IMAGE

[75] Inventors: Hugh B. Skees; Frank V. Parenti, both of Dayton, Ohio

[73] Assignee: The Standard Register Company, Dayton, Ohio

[21] Appl. No.: 200,449

[22] Filed: Oct. 24, 1980

[51] Int. Cl.[3] ..... B44F 1/10

[52] U.S. Cl. ..... 428/29; 283/8 B; 283/9 R; 427/7; 427/145; 427/150; 427/151; 428/320.8; 428/321.5; 434/328

[58] Field of Search ..... 427/145, 150, 151, 7; 283/8 B, 9 R; 434/328; 428/29, 320.8, 321.5

[56] References Cited

U.S. PATENT DOCUMENTS

| | | | |
|---|---|---|---|
| 1,447,723 | 3/1923 | Imhof et al. | 427/145 |
| 2,505,471 | 4/1950 | Green . | |
| 3,427,180 | 2/1969 | Phillips, Jr. . | |
| 3,672,935 | 6/1972 | Miller et al. . | |
| 3,697,323 | 10/1972 | Brown, Jr. et al. . | |
| 3,725,104 | 4/1973 | Fraik | 427/145 |
| 3,732,141 | 5/1973 | Brockett et al. . | |
| 3,894,168 | 7/1975 | Brockett et al. . | |
| 3,940,539 | 2/1976 | Horinouchi et al. . | |
| 4,010,292 | 3/1977 | Shackle et al. . | |
| 4,109,047 | 8/1978 | Frederickson | 427/145 |
| 4,197,346 | 4/1980 | Stevens | 427/150 |
| 4,198,445 | 4/1980 | Sokol et al. | 427/145 |
| 4,199,618 | 4/1980 | Golden | 427/145 |
| 4,199,619 | 4/1980 | Oda et al. | 427/150 |

*Primary Examiner*—Norman Morgenstern
*Assistant Examiner*—Janyce A. Bell
*Attorney, Agent, or Firm*—Jacox & Meckstroth

[57] ABSTRACT

A hidden image, which can be made detectable by rubbing, is produced by applying to a substrate surface a first ink-like material in image configuration, then applying a second ink-like material to cover the image and an area surrounding the image. Each of the first and second ink-like materials contain one of a color-forming pair of reactants which are colorless or light colored in their unreacted states, but which together produce a colored product when brought into reactive contact. Separation of the two reactants is assured by encapsulating at least one of the reactant pair. Reactive contact is caused by rubbing the printed area or otherwise applying sufficient pressure to rupture the capsules, releasing one of the reactants into intimate contact with the other reactant.

8 Claims, 2 Drawing Figures

SELF-CONTAINED COVERT IMAGE

FIELD OF THE INVENTION

The present invention relates to the production of a self-contained covert image and material bearing such a covert image; more particularly, the present invention relates to a material bearing a coating, on which the covert image cannot be seen until the printed area is rubbed or scratched, thereby revealing the covert image.

BACKGROUND OF THE INVENTION

Various means have been used in the past to produce hidden or covert images. The most obvious utility for such covert images is perhaps the use of secret messages by agents of a political entity. Use of such covert images, however, is not necessarily primarily used for espionage, but are also used as an aid in prevention of fraudulent or counterfeit negotiable and/or non-negotiable documents and for determining winners in certain kinds of games and contests.

In the prior art, one known method for providing a covert image is to print a document with a background pantograph image, which contains a chemical ingredient which changes color when a bleach solution or other "ink" eradicator is applied. This means is not desirable as the application of a second chemical ingredient is necessary in order to cause the image to become visible. Thus, this means would not be suitable, for example, for games or contests, in which the general public desiring to reveal the covert image would not have access to such a chemical.

Another method known in the prior art is to print a document with an ink which contains a component which is colorless in visible light, but which fluoresces in a visible color when exposed to ultraviolet light. This method is also undesirable, in that it requires the party desiring to reveal the covert image to have access to additional equipment, i.e. a source of ultraviolet light.

A third manner known in the prior art to obtain a covert image is to print an image form on a document with an ink containing an abrasive pigment. When a coin or other metallic instrument is rubbed over the image, metal particles sare removed from the rubbing instrument and retained on the image, thus darkening the image. This method has the disadvantage that it is not possible to totally hide the image. The image which is intended to be covert can be seen to some extent, thus making it inappropriate for most end uses.

A fourth method of preparing covert images is to print an image on a substrate and then apply an opaque coating over it to hide it. The image is later made visible by scratching or rubbing away the overcoating to expose the image. This method is undesirable in view of the mess that is made by the scratched off coating.

SUMMARY OF THE INVENTION

Accordingly, it is an object of the present invention to eliminate the deficiencies of the prior art, such as those set forth hereinabove.

It is a further object of the present invention to provide an improvement in the art of covert image formation.

It is another object of the present invention to provide a covert image which is self-contained and which has all of the ingredients for developing the image present on the substrate surface.

It is yet another object of the present invention to provide a covert image which can be made visible simply by rubbing or pressure, without scraping away an overcoating.

It is still another object of the present invention to provide an image which is totally undecipherable until deliberately developed.

It is yet a further object of the present invention to produce a covert image which is easily produced by conventional printing techniques.

It is still another object of the present invention to provide a covert image using materials which are low cost, readily available and are non-toxic and non-polluting.

It is yet another object of the present invention to provide a method for producing such a covert image.

These and other objects of the present invention are obtained by means of the present invention in which a first ink-like material is applied to a substrate surface in image configuration, and then a second ink-like material is applied to cover the image and an area surrounding the image. Each of the first and second ink-like materials contain one of a color-forming pair of reactants which are colorless or light-colored in their unreacted states, but which together produce a colored product when brought into reactive contact. Separation of the two reactants is assured by encapsulating at least one of the reactant pair. Reactive contact is caused by rubbing the printed area or otherwise applying sufficient pressure to rupture the capsules, releasing one of the reactants into intimate contact with the other reactant, thereby causing the first ink-like material to become colored and visible.

BRIEF DESCRIPTION OF THE DRAWINGS

The present invention will be better understood from a consideration of the attached drawings, in which.

DETAILED DESCRIPTION OF PREFERRED EMBODIMENTS

Figure 1:
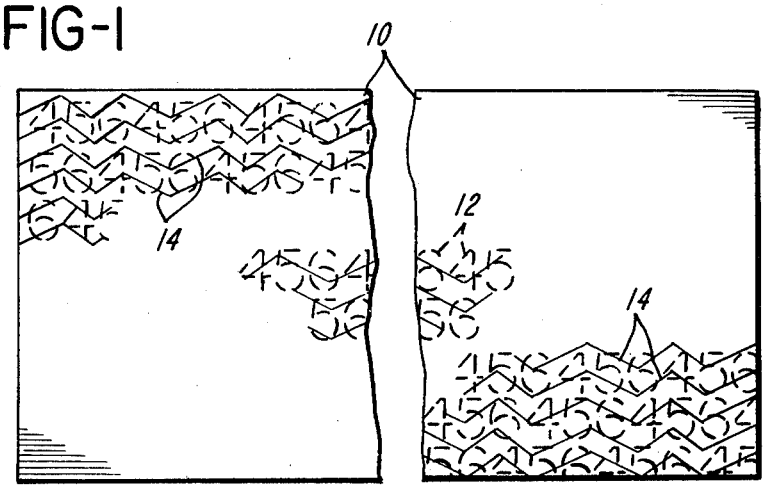
FIG. 1 is a plan view of a substrate containing the covert image.

To produce the covert image in accordance with the present invention, two chemical components are selected, having two essential characteristics, i.e. that they are reactive toward one another, and that the reaction product has a color different from either of the reactants. Preferably, both reactants are colorless or of a light color, and the reaction product is strongly colored.

Examples of suitable reactant pairs are those conventionally used in the carbonless copy paper industry. Such pairs generally include a colorless dyestuff precursor as one of the pair, and a color developer, or dyestuff acceptor, as the other member of the pair.

Among the well-known basic, reactive, colorless, chromogenic dye precursors useful for developing colored marks when in reactive contact with a suitable color developer are crystal violets lactone (CVL), the p-toluene sulfonate salt of Michler's hydrol or 4,4'bis(-diethyl amino)benzhydrol, benzoyl leuco methylene blue (BLMB), indolyl red, malachite green lactone, 8'-methoxy-benzoindoline spiro-puran, rhodamine lactone, and mixtures thereof.

Known color developers, useful with such dye precursors are phenolic resins, such as acetylated phenolic resins, salicylic acid modified phenolics and novalac type phenolic resins, salicylic acid derivatives, such as di-tertbutyl salicylic acid, metal salts, particulary zinc salts, of such phenolic resins or salicylic acid derivatives, natural clay ores, such as attapulgite clay, bentonite, kaolinite and montmorillonite, and inorganic materials, such as finely powdered silicic anhydride, magnesium silicate and aluminum oxide.

Specific examples of suitable reactant pairs are CVL and phenolic resin, CVL and attapulgite clay, BLMB and attapulgite clay, p-toluene sulfonate of Michler's hydrol and phenolic resin, CVL and zinc salt of di-tertbutyl salicylic acid, etc. Many other examples of color-forming reactive pairs are disclosed in the patent literature. Any such convenient or suitable materials may be used.

Each member of the reactant pair is incorporated into an ink-like formulation. The "ink" may be one suitable for printing by any of the convenient printing processes, including letterpress, lithography, flexography, gravure or silk screen. The other ingredients incorporated into the ink formulation must be chosen from materials, which do not interfere with the color formation reaction, all as is well known to the prior art.

One of the ink-like formulations is printed in image formation onto a suitable substrate, preferably and usually paper. The second ink-like formulation is printed or coated over this image and either covers the image totally or partially, or is applied in an area closely adjacent to the image. The second ink-like material may be applied as a layer of uniform thickness, or may be applied in the form of an image, the second image being different from the first image. Either one or both of these ink-like formations must have the property of maintaining its co-reactant in physical isolation from the other reactant in the other ink-like formulation.

The preferred embodiment of the present invention comprises a first ink-like formulation, printable by letterpress or transfer letterpress printing. Such a reactive ink is disclosed in U.S. Pat. No. 4,060,262, in which the preferred reactant is a phenolic resin of the novolac type. That reactive ink disclosed in U.S. Ser. No. 691,497, filed Nov. 17, 1978, or the continuation-in-part thereof, both of which are owned by the present assignee, is also particularly preferred as such a composition is readily printable by conventional printing apparatus.

The preferred second ink-like formulation is prepared in microcapsules by well-known procedures, such as the following:

A chromogenic dye precursor is dissolved in a suitable solvent. A suitable solvent is one which is a solvent for the dye precursor, provides a suitable reactive medium for the two reactants to undergo their color-forming reaction, and can be emulsified in water. For example, the solvent may be di-isopropyl naphthalene, diethyl phthallate, dibutyl sebacate, or other relatively low volatility solvents, well known in the chemical carbonless copy paper art. The preferred dye precursor is crystal violet lactone, either alone or in combination with other dyes, such as Pergascript 1-6 D and Pergascript 1-3 G, products of Ciba-Geigy Company.

In addition to the dye precursor dissolved in the solvent (concentration in the range of 1 to 5%), a polymeric polyisocyanate is also dissolved in the solvent. A suitable polyisocyanate is Desmodur L 2291-A, a product of Mobay Chemical Corporation, and is used in a quantity of 3 to 6%, based on the solvent.

This solution containing the dye precursor and polyisocyanate is emulsified in an aqueous solution of animal gelatin or polyvinyl alcohol. A suitable gelatin is a 110 g strength gelatin from Hudson Industries Corporation. The gelatin solution is made at a strength of 10 to 20% and preferably 15 to 18%. The mixture is emulsified under high shear mechanical agitation until the droplet size has reached a range of 2 microns to 20 microns, preferably 5 to 8 microns. Once formed, the emulsion is greatly agitated for two hours at 60° C. to promote the formation of solid polyurethane walls around the droplets, thus producing a slurry of microcapsules. If desired, additional binder resin may be added to the slurry.

The second ink-like formulation is then printed or coated over the first ink-like image by suitable printing processes, such as flexography or gravure or a coating process, such as roll, wire rod, offset gravure, etc. The process is suitable for printing on continuous webs of paper through rotary printing presses, as well as individual sheets.

Optionally, a coloring material may be added to the second ink-like material to help conceal the image. It may be that the image will undesirably develop some color, due to the presence of small amounts of the dye precursor not being completely contained inside the capsules. If this is the case, the color added to the second ink helps conceal the covert image.

An additional aid in concealing the covert image is to print the second ink in the form of a scrambled block-out design or a pantograph. Thus, if the covert image develops some color, the additional image confuses the eye, making it more difficult to recognize the covert image. The second ink may also be applied as a solid colored coating, although this is not preferred, as a scrambled coating makes it more difficult to recognize the covert image until it is completely brought out.

Figure 2:
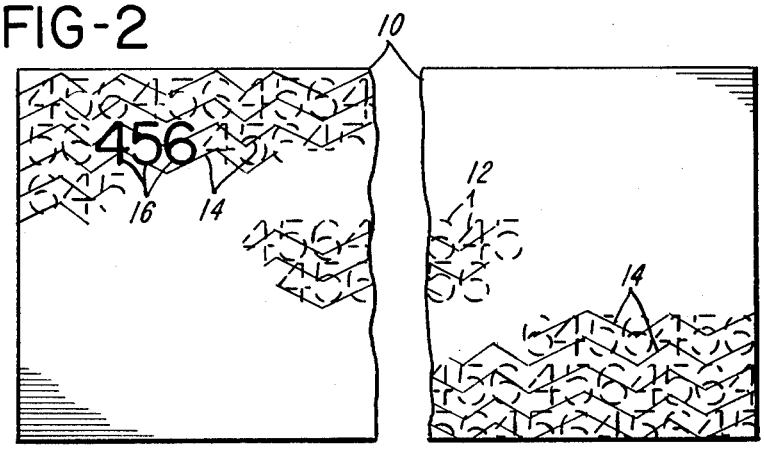
FIG. 2 is a plan view of a substrate after the covert image has been made visible.

An example of such a concealed covert image is shown in the present drawings. FIG. 1 shows a substrate 10 bearing a covert image pattern 12 of first ink material, which is colorless and invisible and thus indicated by dashed lines. The second ink-like formulation is tinted in a light color and applied in a black-out or pantograph design 14 over the first image. Upon scratching of the surface with a fingernail, the edge of a coin, etc., the microcapsules are ruptured and a reaction takes place in the area scratched, causing the first and second ink-like formulations to react, thus producing a dark colored image 16, as illustrated in FIG. 2, in which the previously covert image becomes highly visible in the area scratched.

Another aid in concealing the covert image is to print the first image, or covert image, in the form of dots, lines, or other shapes with spaces therebetween. The second ink is then printed in a complementary pattern, wherein dots, lines, or other shapes are laid down between those of the first ink.

Once these reactive inks are applied and dried, the covert image is indistinguishable from its background area. When it is desired to view the covert image, the area is rubbed, for example with a fingernail, edge of a coin, etc. The abrasion or pressure thus applied breaks the capsules, releasing dye precursor solution, which contacts the co-reactant, forming a color image.

It must be understood that while the present invention has been described in terms of the reactants previously used in the carbonless copy paper industry, the present invention is not limited to such formulations, and the first and second ink formulations may be made of any materials in which the covert image cannot be seen until the two materials react. Furthermore, while the substrate is preferably paper, the present invention is obviously not limited thereto and any substrate may be used on which the first and second ink-like formulations may be printed and which does not interfere with the color-forming reaction. Furthermore, it will be understood that within the purview of the present invention, various changes mays be made in the form, proportion and ingredients and the combination thereof which, generally stated, consist in a method and composition capable of carrying out the objects set forth, as disclosed and defined in the appended claims.

What is claimed is:

1. A material bearing a self-contained covert image, comprising:

a substrate;

a coating of a first ink-like material on said substrate in the configuration of the desired covert image; and a coating on said substrate of a second ink-like material which is tinted with a color which does not obscure the image obtained after reaction of said first and second ink-like materials, said second ink-like materials being printed in the form of an overt image, said overt image being sufficiently different from said covert image to confuse the eye of the observer and thereby make it more difficult to recognize said covert image;

wherein each of said first and second ink-like materials contain an opposite one of a color-imaging pair of reactants which are colorless or light colored in their unreacted state, but which together produce a colored product when brought into reactive contact, and wherein said overt image coating is at least partially coextensive with said covert image coating and at least one of said first and second ink-like materials are micro-encapsulated to prevent reactive contact of the materials and to permit reactive contact after rupture of the microcapsules.

2. A covert image bearing material in accordance with claim 1, wherein said substrate is paper.

3. A covert image bearing material in accordance with claim 1, wherein said first ink-like material is in a formulation making it printable by a standard printing press.

4. A covert image bearing material in accordance with claim 1, wherein only said second ink-like material is microencapsulated.

5. A covert image-bearing material in accordance with claim 1, wherein said overt image is in the form of a scrambled block-out design or pantograph.

6. A method of producing a covert image, comprising:

printing the configuration of the desired covert image onto a substrate in a first ink-like material; and printing onto said substrate a second ink-like material which is tinted with a color which does not obscure the image obtained after reaction of said first and second ink-like materials, said second ink-like material being printed in the form of an overt image, said overt image being sufficiently different from said covert image to confuse the eye of the observer and thereby make it more difficult to recognize said covert image;

wherein each of said first and second ink-like materials contain an opposite one of a color-imaging pair of reactants which are colorless or light colored in their unreacted state, but which together produce a colored product when brought into reactive contact, and wherein said overt image is at least partially coextensive with said covert image and at least one of said first and second ink-like materials are micro-encapsulated to prevent reactive contact of the materials and to permit reactive contact after rupture of the microcapsules.

7. A method in accordance with claim 6, wherein said overt image is in the form of a scrambled block-out design or pantograph.

8. A method in accordance with claim 6, wherein said step of printing the configuration of the desired covert image is accomplished first, followed by said step of printing said second ink-like material.

* * * * *